United States Patent [19]

Voliva

[11] 4,415,507

[45] Nov. 15, 1983

[54] MIXING VALVE FOR DUAL FUEL CARBURETOR AND METHOD OF DUAL CHARGE MIXING PERFORMED THEREBY

[76] Inventor: Elmer A. Voliva, P.O. Box 542, Midland, Tex. 79702

[21] Appl. No.: 337,477

[22] Filed: Jan. 6, 1982

[51] Int. Cl.[3] ..... F02M 43/00

[52] U.S. Cl. ..... 261/18 B; 261/23 A; 123/52 MB; 123/575; 123/590; 123/593

[58] Field of Search ..... 261/18 B, 23 A; 123/52 MB, 575, 590, 593

[56] References Cited

U.S. PATENT DOCUMENTS

| | | | |
|---|---|---|---|
| 2,098,178 | 11/1937 | Corse | 261/18 B |
| 2,124,403 | 7/1938 | McIntyre | 123/575 |
| 2,652,237 | 9/1953 | Boller | 261/18 B |
| 2,661,269 | 12/1953 | Briggs | 123/593 |
| 3,061,285 | 10/1962 | Garski et al. | 261/23 A |
| 3,282,572 | 11/1966 | Karlovitz | 123/52 MB |
| 3,607,155 | 9/1971 | Faltermeier | 123/590 |
| 4,020,812 | 5/1977 | Hayward | 123/593 |
| 4,182,296 | 1/1980 | Fayard | 123/590 |
| 4,191,140 | 3/1980 | Matsumoto et al. | 123/52 MB |
| 4,256,063 | 3/1981 | Sumiyoshi et al. | 261/23 B |

FOREIGN PATENT DOCUMENTS

| | | | |
|---|---|---|---|
| 14642 | 3/1926 | Netherlands | 261/18 B |

OTHER PUBLICATIONS

Raab et al., "Convert your Car to Run on Alcohol Fuel", Automotive Engr. Pubs., 5641 Newton Ave. So., Minneapolis, Minn. 55419, Apr. 1980.

*Primary Examiner*—Tim R. Miles

*Attorney, Agent, or Firm*—Harvey B. Jacobson

[57] ABSTRACT

An assemblage is provided for effecting thorough mixing of two different air and fuel charges such as a first charge of air and gasoline vapors and a second charge of air and alcohol vapors. The assemblage is constructed in the form of a spacer block assembly to be interposed between a multibarrel carburetor mounting base and the carburetor mounting boss of an associated combustion engine intake manifold. The assemblage is further to be used in conjunction with a multibarrel carburetor modified to form a first air and fuel charge in one of the barrels thereof and a second air and fuel charge in a second barrel thereof. The spacer block assembly defines at least one pair of passages extending therethrough including corresponding inlet ends for registry with the outlet ends of the carburetor barrels and outlet ends for registry with the inlet ends of the corresponding air and fuel passages of the associated intake manifold. The assemblage includes structure, intermediate the inlet and outlet ends of the passages formed therethrough, operable to divert generally the same proportion of the fluid flow supplied to each of the passages from the corresponding carburetor barrel into the other passage for admixing with the non-diverted portion of the fluid flow therethrough.

13 Claims, 5 Drawing Figures

MIXING VALVE FOR DUAL FUEL CARBURETOR AND METHOD OF DUAL CHARGE MIXING PERFORMED THEREBY

BACKGROUND OF THE INVENTION

In an attempt to reduce the consumption of gasoline and to also reduce exhaust emissions, some suppliers of automotive gasoline have recently made available gasohol which comprises a mixture of approximately 90% gasoline and 10% alcohol. Gasohol may be used effectively in existing gasoline vehicle engines, but gasohol presents several problems for the users thereof.

One such problem resides in the fact that gasohol, even a low 10% proportion of alcohol, tends to separate from the 90% gasoline content thereof as a result of water contamination, inasmuch as the alcohol tends to absorb the water. Accordingly, even though the marketing of gasohol may be more closely controlled than the marketing of gasoline so as to minimize the chances of water contamination, persons who may occasionally use gasoline in the event of difficulty in obtaining gasohol sometimes experience increased water contamination during subsequent use of gasohol as a result of the intermediate purchase of gasoline which may have a higher water contamination than is generally considered permissible with gasohol. Also, fluctuating temperatures may cause water from the atmosphere within a partially filled fuel tank to condense and further increase water contamination of gasohol.

It is also pointed out that several types of seals and gaskets conventionally used in gasoline fuel systems tend to deteriorate when gasohol rather than gasoline is used in those systems.

Accordingly, a need exists to provide a means whereby an effective gasohol air and fuel mixture ultimately may be supplied to the combustion chambers of an internal combustion engine without the aforementioned problems encountered as aresult of water contamination and gasket and sealed deterioration. Still further, a need exists for an effective means of supplying a gasohol air and fuel charge to the combustion chambers of an internal combustion engine with the alcohol component of the fuel charge being greater than 10% in order that a greater reduction in gasoline usage may be realized.

Various forms of dual flow path charge forming and mixing devices including some of the general structural and operational features of the instant invention are disclosed in U.S. Pat. Nos. 3,223,390, 4,003,357, 4,018,199, 4,019,476, 4,031,875, 4,031,876 and 4,261,311.

BRIEF DESCRIPTION OF THE INVENTION

The dual charge mixing apparatus of the instant invention is constructed in the form of a spacer block for interposing between the outlet base of a multibarrel carburetor and the carburetor mounting boss of the intake manifold of an associated combustion engine. The mixing apparatus includes a pair of passages formed therethrough including corresponding inlet and outlet ends and further includes flow diverting structure, intermediate the aforementioned inlet and outlet ends, operable to divert generally the same proportion of the fluid flowing into each of said passages to the other passage for mixing with the non-diverted portion of the fluid flowing therethrough. In this manner, one barrel of an assicuated carburetor may be effective to form a charge consisting of air and gasoline vapors and a second barrel of the associated carburetor may be effective to form a charge of air and alcohol vapors.

Although multifuel carburetors are not generally known, many multi-barrel carburetors include dual float chambers and may be readily converted to a dual fuel carburetor merely by supplying one liquid fuel (gasoline) to one of the float chambers and supplying a second liquid fuel (alcohol) to the other float chamber. Thus, the immediate feasiblity of the mixing apparatus of the instant invention is readily apparent.

The main object of this invention is to provide a dual fuel charge forming system for a combustion engine operative to first form separate air and fuel charges of two different fuels such as gasoline and alcohol and to thereafter thoroughly mix the two fuel charges prior to induction of the two fuel charges into the combustion chambers of an associated internal combustion engine.

Another object of this invention is to provide an apparatus in accordance with the preceding objects and which will require minimum modification of an existing gasoline powered combustion engine fuel system.

Still another important object of this invention is to provide a dual fuel charge system which may be readily converted from continuous dual fuel operation to dual fuel operation only during periods of engine operation under heavy loads.

Further, another object of this invention is to provide a dual fuel system for an internal combustion engine which may be readily further modified to enable selective fuel operation of the combustion engine.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
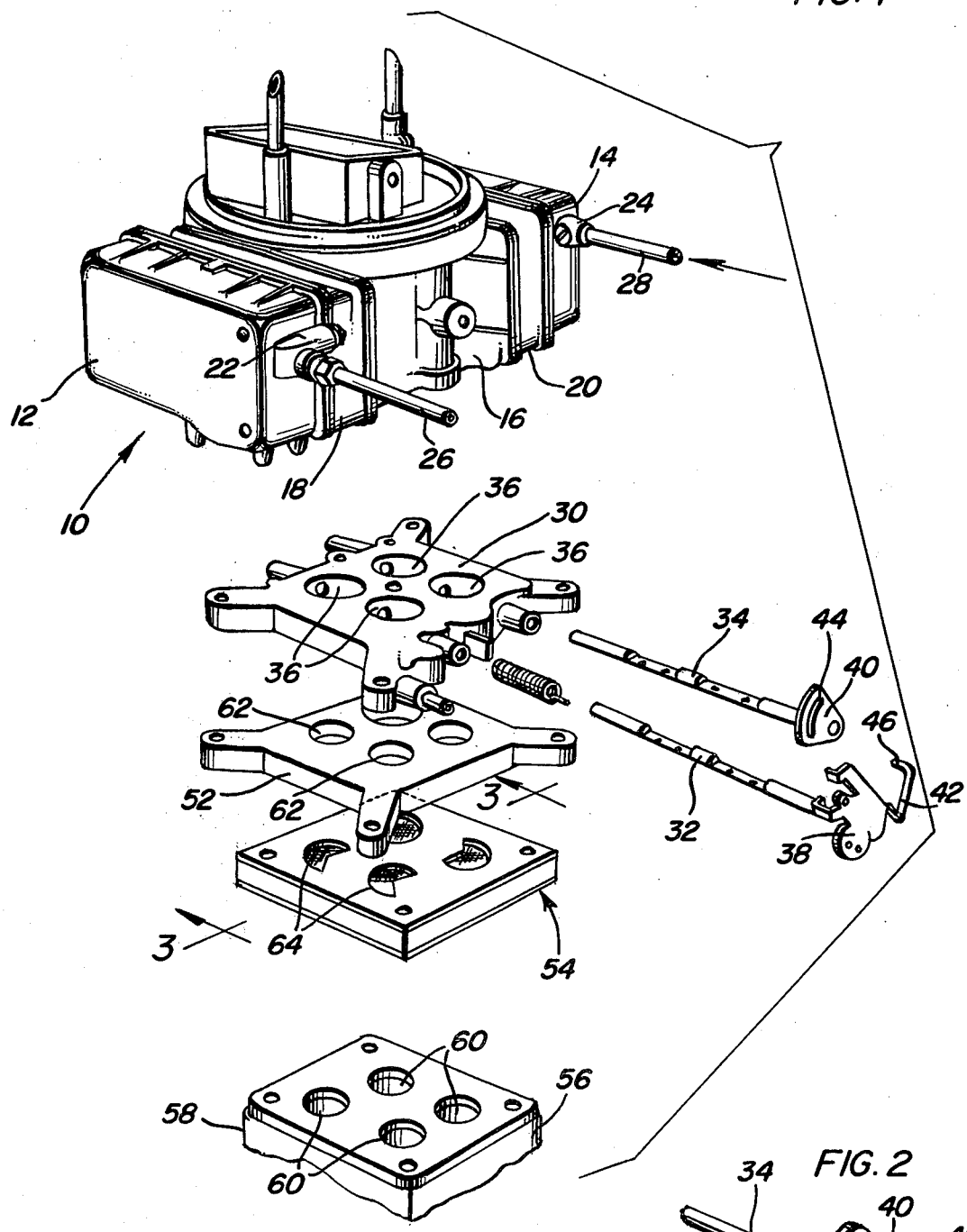
FIG. 1 is a perspective view illustrating a typical dual float chamber carburetor with its base in exploded position and with the mixing valve of the mixing invention and a spacer plate being provided for disposition between the carburetor base plate and an associated intake manifold mounting boss.

Referring now more specifically to the drawings, the numeral 10 generally designates a typical "HOLLEY" 4150-60 carburetor including primary and secondary fuel or float bowls 12 and 14 supported on opposite sides of the body 16 of the carburetor outboard of a pair of metering blocks 18 and 20 thereof. The bowl 12 includes a fuel inlet 22 and the bowl 14 includes a fuel inlet 24. Conventionally, the two fuel inlets 22 and 24 are in direct communication with each other through the utilization of a straight fuel line (not shown) extending between and opening into the adjacent sides of the inlets 22 and 24 and with a main gasoline supply line 26 opening into the fuel inlet 22 as shown.

In modifying the carburetor 10 for use in conjunction with the instant invention, the adjacent sides of the fuel inlets 22 and 24 are suitably plugged and an alcohol fuel supply line 28 opens into the inlet 24 and thus into the secondary fuel or float bowl 14.

Figure 2:
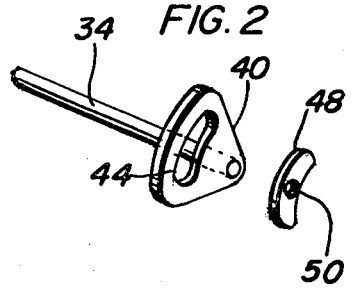
FIG. 2 is a fragmentary exploded perspective view illustrating slight modification which may be made to one of the throttle plate lever arms of the carburetor in order to adapt it for use in conjunction with the mixing valve of the instant invention.

In addition, the base plate 30 of the carburetor 10 includes primary and secondary throttle shafts 32 and 34 journalled therefrom with each throttle shaft including a pair of generally circular throttle plates (not shown) for disposition in the corresponding barrel outlet ends 36 formed in the base plate 30. Conventionally, the primary throttle plate shaft 32 is equipped with an accelerator linkage controlled operating arm 38 and the secondary throttle plate shaft 34 has an operating arm 40 mounted thereon to which the primary throttle plate shaft 32 is operably connected through the utilization of a connecting link 42 establishing a lost motion connection between the shaft 32 and the shaft 34 by a pin and slot connection with the arm 40 established by a slot 44 formed in the arm 40 and a pin 46 provided on one end of the connecting link 42. However, in order to further modify the carburetor 10 for use in conjunction with the instant invention, an arcuate insert 48, see FIG. 2, is installed within the slot 44 of the arm 40 and the insert 48 includes a bore 50 formed therein only slightly larger in diameter than the pin 46. In this manner, the throttle plate shaft 34 is directly driven from the throttle plate shaft 32 for simultaneous opening and closing of the throttle plates supported from the shafts 32 and 34.

If it is deemed necessary, a spacer plate 52 of conventional design may be disposed beneath the base plate 30 in order to prevent interference between the throttle controls of the carburetor 10 and the mixing apparatus of the instant invention, the latter being generally designated by the reference numeral 54 and being constructed in the form of a second spacer block for being interposed between the spacer block 52 and the mounting boss 56 of the associated intake manifold 58. It will be noted that the carburetor barrel outlet ends 36 are registered with the intake passages 60 formed in the mounting boss 56, that the spacer plate includes passages 62 formed therethrough registered with the barrel outlet ends 36 and passages 60 and that the mixing apparatus defines four flow paths 64 formed therethrough registered with the passages 60 and 62.

Figure 3:
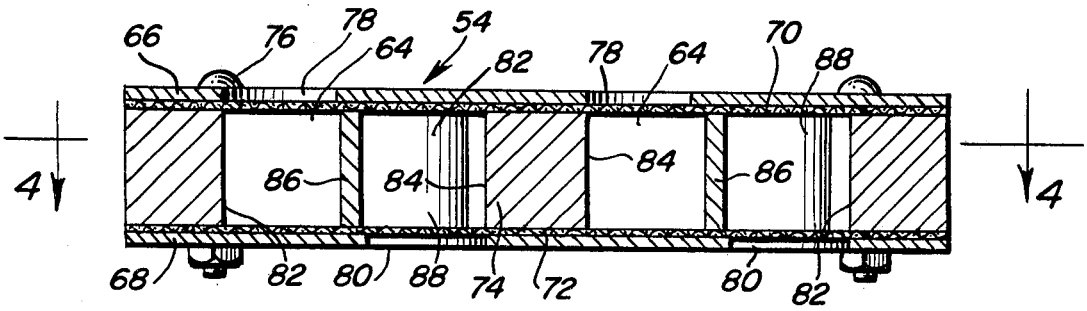
FIG. 3 is an enlarged fragmentary vertical sectional view of the mixing valve taken substantially upon a plane indicated by the section line 3—3 of FIG. 1.
Figure 4:
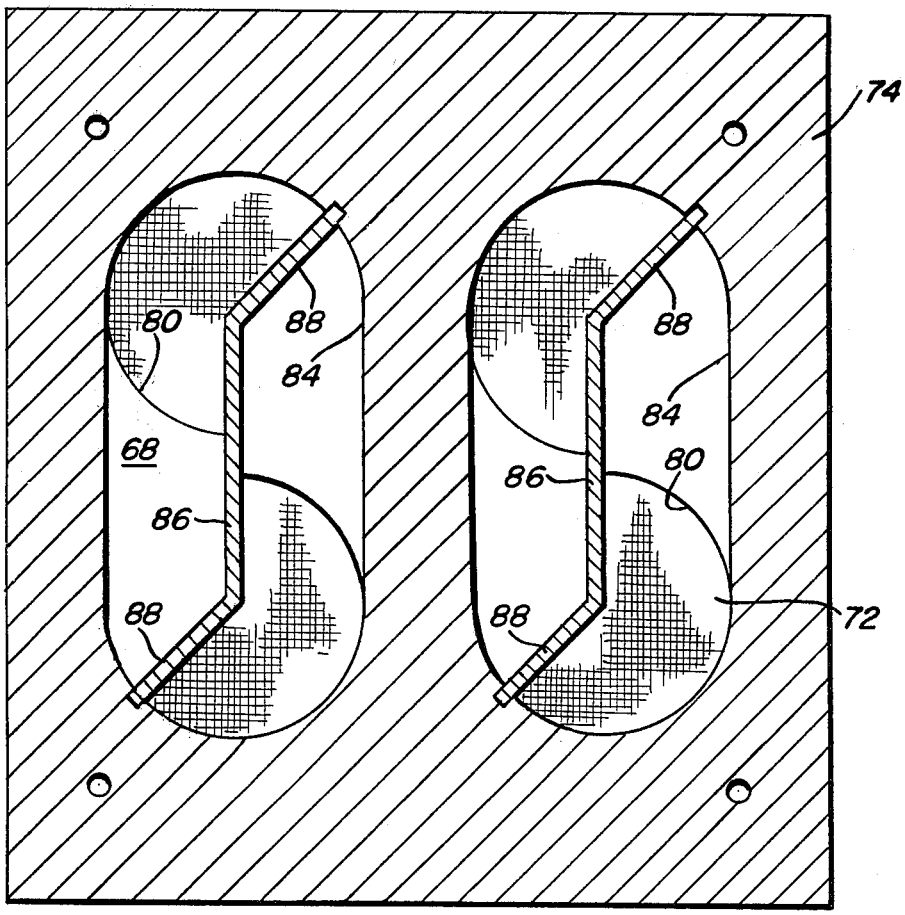
FIG. 4 is a horizontal sectional view taken substantially upon the plane indicated by the section line 4—4 of FIG. 3.
Figure 5:
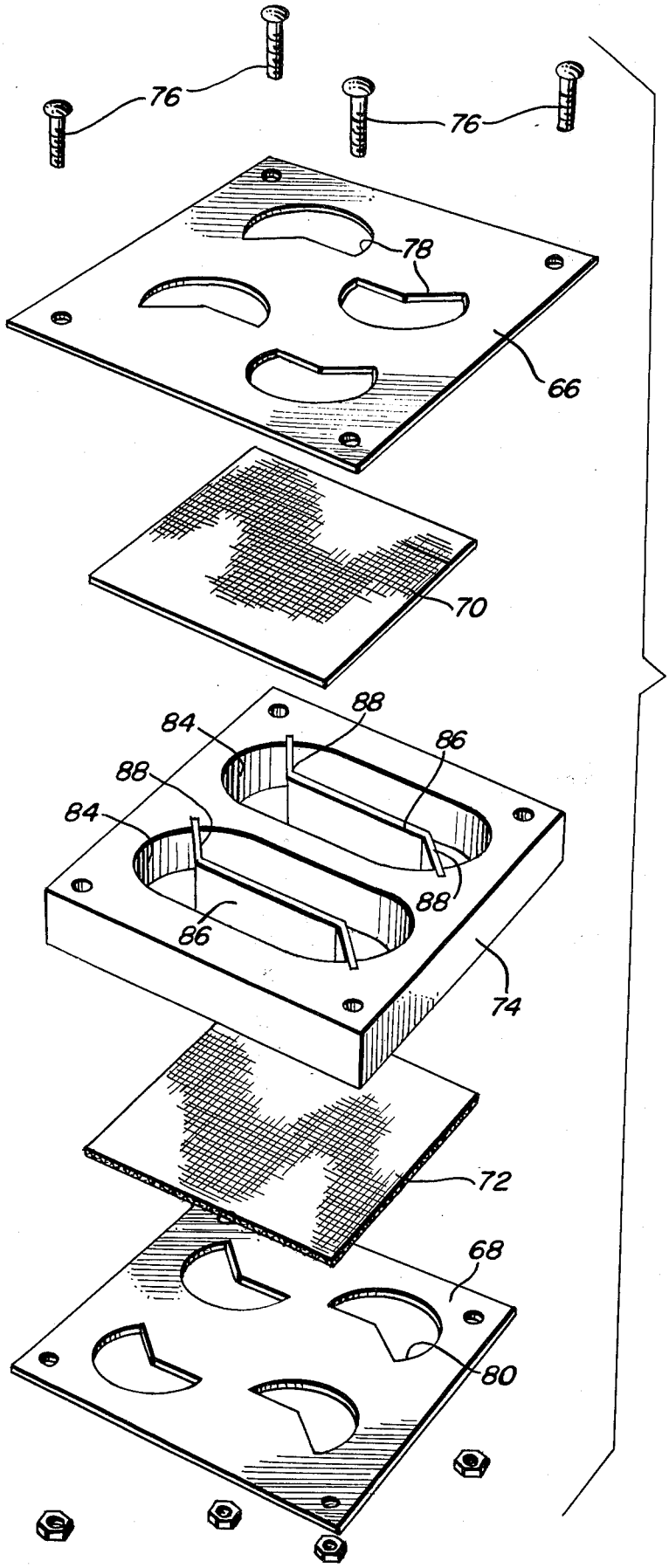
FIG. 5 is an exploded perspective view of the mixing valve.

With attention now invited more specifically to FIGS. 3, 4 and 5, it may be seen that the charge mixing apparatus 54 includes a pair of upper and lower plates 66 and 68, a pair of upper and lower screens 70 and 72 disposed immediately beneath and above the plates 66 and 68 and a central horizontal block 74 disposed between the screens 70 and 72. A plurality of corner fasteners 76 are secured through the plates 66 and 68, the screens 70 and 72 and the block 74 to retain all of the components of the mixing apparatus 54 in contact position relative to each other prior to installation of the mixing apparatus. During installation of the mixing apparatus, the fasteners 76 are removed and the openings formed through the various components of the mixing apparatus 54 through which the fasteners 76 are received are positioned for receiving therethrough the mounting studs or bolts utilized to secure the four board corner portions of the plates 30 and 52 to the mounting boss 56 of the intake manifold 58.

The flow paths 64 formed through the mixing apparatus 54 include separate inlet ends defined by openings 78 formed in the plate 66, separate outlet ends formed by openings 80 formed in the plate 68 and separate intermediate portions 82 formed by horizontally oblong passages 84 formed vertically through the block 74. In addition, each of the passages 84 includes rounded opposite ends which are registered with corresponding gasoline and alcohol fuel charge barrel outlet ends 36 of the carburetor 10 and each oblong passage 84 includes an edge upstanding and longitudinally extending fence 86 mounted therein including oppositely angled opposite end portions 88. The openings 78 and 80 formed in the plates 66 and 68 are not circular, but are in the form of a pie-cut void of approximately 215° in angular extent. Because of the orientation of the oppositely angled opposite end portions 88 of the fences 86 and the angular positioning of the openings 78 and 80 slightly more than one-half of the air and fuel charge entering each opening 78 is diverted to the opposite end of the associated oblong passage 84 which opens into the remote outlet opening 80. Thus, substantially identical proportions of the alcohol and air and gasoline and air charges passing through the inlet openings 78 are diverted to the gasoline and air and alcohol and air charge outlet openings 80. As a result of this diversion of fuel charges entering the mixing apparatus 54 predetermined portions of the alcohol and air charges are admixed with the non-diverted portions of the gasoline and air charges and corresponding portions of the gasoline and air charges entering the mixing apparatus are diverted and admixed with the non-diverted portions of alcohol and air charges passing through the mixing apparatus 54.

Thus, with the embodiment specifically illustrated in the drawings, operation of the associated throttle linkage causes simultaneous operation of throttle plate shafts 32 and 34 and a constant proportion mixture of alcohol and air and gasoline and air charges to be supplied to the associated combustion engine. However, inasmuch as the associated engine may operate in the conventional manner with fuel being supplied only from the primary float chamber during light load operation and fuel being supplied to the associated engine from the secondary float chamber or bowl only during heavy load operations, the insert 48 may be omitted in order that light load operation of the associated engine may be effected as a result of a gasoline and air charge and heavy load operation of the associated engine may be effected by dual fuel operation including both a gasoline and air fuel charge and an alcohol and air fuel charge. Still further, suitable selective throttle shaft operating mechanisms may be provided whereby the associated engine may be selectively operated on only a gasoline and air fuel charge or an alcohol and air fuel charge.

Although the carburetor 10 comprises a 4-barrel carburetor including a pair of float chambers, similar carburetor construction of the 2-barrel type may be utilized with each barrel of the 2-barrel carburetor being under the control of a separate float chamber.

In order to adapt a conventional engine for use in accordance with the instant invention, it is only necessary to install the mixing apparatus 54 and to provide an alcohol fuel tank, pump and fuel line opening into the fitting 24. Further, it may be seen that only minimal modifications need be made to the carburetor 10 in order to adapt the associated internal combustion engine for simultaneous or selective dual fuel operation as a result of utilization of the mixing apparatus 54 of the instant invention.

The screens 70 and 72 serve to break up droplets of fuel passing therethrough and to further insure greater atomization of both the gasoline and alcohol fuel. Further, inasmuch as the openings 78 and 80 are of a smaller effective cross-sectional area than the barrels 36 or passages 60 or 62, the mixing apparatus 54 serves to subject both the gasoline and air and the alcohol and air charges to successive zones of expansion. The first zone of expansion comprises the oblong passages 84 and the second zone of expansion comprises the passages 60 formed in the intake manifold 58. These successive zones of expansion are disposed immediately downstream from the openings 78 and 80 and serve to further enhance atomization of the gasoline and alcohol charges.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. For use in conjunction with a dual charge forming apparatus of the type including a pair of charge flow passages having outlet ends for registry and communication with the inlet ends of a pair of combustion engine charge induction passages, a dual charge mixing apparatus defining a pair of flow paths extending therethrough and including inlet and outlet ends for registry and communication with said outlet ends of said charge flow passages and said inlet ends of said induction passages, respectively, said charge mixing apparatus including flow diverting means, intermediate said inlet and outlet ends of said flow paths, operable to divert generally the same proportion of the charge flowing through each of said flow paths into the other flow path for admixing with the non-diverted portion of the charge flowing therethrough.

2. The mixing apparatus of claim 1 wherein said flow diverting means includes means operative to establish a proportion of diverted charge greater than the non-diverted portion of charge.

3. The mixing apparatus of claim 1 including liquid droplet break-up means in each of said flow paths upstream and downstream from said flow diverting means operative to break-up droplets of liquid fuel passing therethrough.

4. The mixing apparatus of claim 1 wherein said inlet and outlet ends of said flow paths are each appreciably smaller in effective cross-sectional area than the portions of said flow paths intermediate said inlet and said outlet ends thereof.

5. The mixing apparatus of claim 1 wherein said apparatus comprises a spacer block assembly through which said flow paths are formed and including remote mounting surfaces through which the inlet and outlet ends of said flow paths open, said spacer block assembly being adapted to be disposed between the mounting base of a charge forming apparatus and the charge forming apparatus mounting face of an associated engine intake manifold.

6. The mixing apparatus of claim 1 wherein the proportion of diverted charge is greater than the non-inverted portion of charge, liquid droplet break-up means in each of said flow paths upstream and downstream from said flow diverting means operative to break-up droplets of liquid fuel passing therethrough.

7. The mixing apparatus of claim 6 wherein said inlet and outlet ends of said flow paths are each appreciably smaller effective cross-sectional area than the portions of said flow paths intermediate said inlet and said outlet ends thereof.

8. The mixing apparatus of claim 7 wherein said apparatus comprises a spacer block assembly through which said flow paths are formed and including remote mounting surfaces through which the inlet and outlet ends of said flow paths open, said spacer block assembly being adapted to be disposed between the mounting base of a charge forming apparatus and the charge forming apparatus mounting face of an associated engine intake manifold.

9. In combination with a carburetor of the type including a pair of charge flow passages extending therethrough and operable to form a different fuel and air charge in each of said passages and with said passages including outlet ends, a dual charge mixing apparatus defining a pair of flow paths therethrough including inlet and outlet ends, the inlet ends of said charge mixing apparatus being registered with the outlet ends of said passages, said charge mixing apparatus including flow diverting means, intermediate the inlet and outlet ends of said flow paths, operable to divert generally the same proportion of the charge flowing through each of said flow paths into the other flow path for admixing with the non-diverted portion of charge flowing therethrough.

10. The carburetor and mixing apparatus combination of claim 9 wherein said fluid flow diverting means includes means operative to establish a proportion of diverted greater than the non-diverted portion of charge.

11. The carburetor and mixing apparatus combination of claim 10 including liquid droplet break-up means in each of said flow paths upstream and downstream from said flow diverting means operative to break-up droplets of liquid fuel passing therethrough.

12. The method of supplying a charge comprising a homogenous mixture of at least two individual combustible vapors to a point of use, said method comprising separately forming each combustible vapor at generally the same pressure and at least initially conveying said vapors toward said port of use through separate passageways therefor including outlet ends communicates with each other, and thereafter diverting, through separate passages, generally the same proportions of said vapors from each passageway into the other passageway at a point upstream from the outlet end thereof.

13. The method of claim 1 wherein the step of diverting generally the same proportions of said vapors from the corresponding passageways into the other passageways includes the step of passing the diverted portions of vapors through successive zones of expansion.

* * * * *